US005498077A

United States Patent [19]

Krzywdzjak et al.

[11] Patent Number: 5,498,077

[45] Date of Patent: Mar. 12, 1996

[54] ADJUSTABLE COUPLING DEVICE FOR DRIVING THE STIRRER ROD SHANK OF STIRRING DEVICES, IN PAINT STIRRING MACHINES

[75] Inventors: Alain Krzywdzjak; Benoit Beulin, both of Orleans, France

[73] Assignee: F.A.S., Orleans Cedex, France

[21] Appl. No.: 147,069

[22] Filed: Nov. 3, 1993

[51] Int. Cl.[6] ..... B01F 7/16; B01F 15/00

[52] U.S. Cl. ..... 366/247; 366/331; 366/605; 403/109; 403/383

[58] Field of Search ..... 366/197–198, 366/207, 242–251, 331, 347, 605; 403/109, 362, 383

[56] References Cited

U.S. PATENT DOCUMENTS

| | | | |
|---|---|---|---|
| 2,757,910 | 8/1956 | O'Neill | 366/605 X |
| 2,802,649 | 8/1957 | Stockton | 366/605 X |
| 2,851,257 | 9/1958 | Morgan | 403/109 X |
| 2,965,363 | 12/1960 | Worden | 366/605 X |
| 3,021,118 | 2/1962 | Dedoes | 366/247 |
| 3,041,052 | 6/1962 | Dedoes | 366/247 |
| 3,145,018 | 8/1964 | Goodwiller | 403/362 X |
| 3,175,808 | 3/1965 | Dedoes | 366/247 X |

*Primary Examiner*—Charles E. Cooley
*Attorney, Agent, or Firm*—Scully, Scott, Murphy & Presser

[57] ABSTRACT

Adjustable coupling device for driving a stirrer rod shank of devices including a stirrer lid positioned on a tin of paint located in a paint stirring machine. A first tube has an upper fork capable of being coupled to a shelf drive plate of the stirring machine, and a second tube whose height is equivalent to that of the first tube has a reduced diameter so that it can slide at a slight clearance within the first tube, with the stirrer rod shank projecting from the stirrer lid so that it can slide with a clearance along the second tube. Fastening of the second tube to the stirrer rod shank and of the second tube relative to the first tube secured against rotation and at the projecting height for coupling the fork to the machine shelf drive plate is effected by two set screws, of which one is, respectively, in engagement with the body of the second tube at the base thereof and tightened onto the stirrer rod shank, and the second screw in engagement with the body of the first tube at its base and tightened against the second tube.

4 Claims, 2 Drawing Sheets

ADJUSTABLE COUPLING DEVICE FOR DRIVING THE STIRRER ROD SHANK OF STIRRING DEVICES, IN PAINT STIRRING MACHINES

BACKGROUND OF THE INVENTION

1. Field of the Invention

The invention relates to the driving connection between the drive system and the paint stirring devices in paint stirring machines. It relates particularly to a heightwise adjustable coupling device for driving the stirrer rod shank of stirrer lids in paint stirring machines. This coupling device is a connection piece known as a "driver".

2. Discussion of the Prior Art

It is known that the distance or height between the shelves for supporting the tins of paint in stirring machines can vary significantly from one manufacturer to another. The driver of each of these stirrer rod shanks of the stirrer lids of tins of paint located on the shelves of the machines generally consists of a sleeve engaged on the stirrer rod shank by means of a set screw tightened as required onto the stirrer rod shank, which is mounted in the bore of the sleeve, and carries an upper fork intended to be coupled at a suitable height to the shelf drive plate of the machine.

Nevertheless, with this connection, the driver sleeve cannot exceed a certain length which corresponds, for paint stirring machines having the smallest intershelf distance, to the maximum permissible distance between the stirrer lid of the tin of paint and the upper drive plate of the machine shelf. This connection using a telescopic sleeve of short length allows only a small, less than 10 mm, heightwise adjustment of the driver, which is insufficient to be fitted to stirring machines having a greater inter-shelf height, especially on machines emanating from the United States and Canada, which machines require an adjustment height which may reach 30–40 mm. Hitherto, this fitting of the driver with a large adjustment height required the stirrer lid to be changed in order to use a taller model of lid allowing heightwise fitting to this conventional connection using a simple sleeve.

SUMMARY OF THE INVENTION

The invention is adapted to overcome these drawbacks by proposing a driver which allows the heightwise adjustment of the coupling for driving the stirrer rod shank of the stirrer lid of the tin over a wise range of height variation which is compatible with the existing machines on the market without requiring the stirrer lid to be changed.

The driver according to the invention is effectively characterized in that it includes a first tube equipped with an upper fork capable of being coupled to the shelf drive plate of stirring machines, and a second tube whose height is equivalent to the first one and whose diameter is reduced, mounted so that it can slide with a slight clearance relative to this tube, the stirrer rod shank emerging from the stirrer lid at its upper part being itself received so that it can slide with a slight clearance by this second tube, the fixing of the second tube to the stirrer rod shank, and of the second tube relative to the first one, in rotational connection and at the extension height required for suitably coupling the fork to the machine shelf drive plate in terms of rotation, being performed by means of two set screws respectively in engagement, as regards the first screw, on the body of the second tube at its base and tightened onto the stirrer rod shank, and in engagement, as regards the second one, on the body of the first tube at its base, and tightened onto the second one.

The advantage of this configuration is to allow a heightwise coupling of the driver which is compatible with the existing stirring machines, this being with a stirrer lid of standard model. The invention also provides a saving of great significance in production lines for manufacturing the stirrer lids by virtue of the use of a standard stirrer lid which can be used on all the stirring machines on the market, regardless of their inter-shelf height.

The width of the said first and second tube is advantageously determined to allow the coupling to be fitted without extending the driver in stirring machines having the smallest inter-shelf height.

The invention also relates to a stirrer lid equipped with a driver as defined previously.

BRIEF DESCRIPTION OF THE DRAWINGS

One embodiment of the invention is described presently with reference to the appended drawings, in which.

DETAILED DESCRIPTION OF THE PREFERRED EMBODIMENT

The invention applies equally well to stirring machines with pots hanging over the shelves and to stirring machines with pots placed on the shelves.

Figure 2:
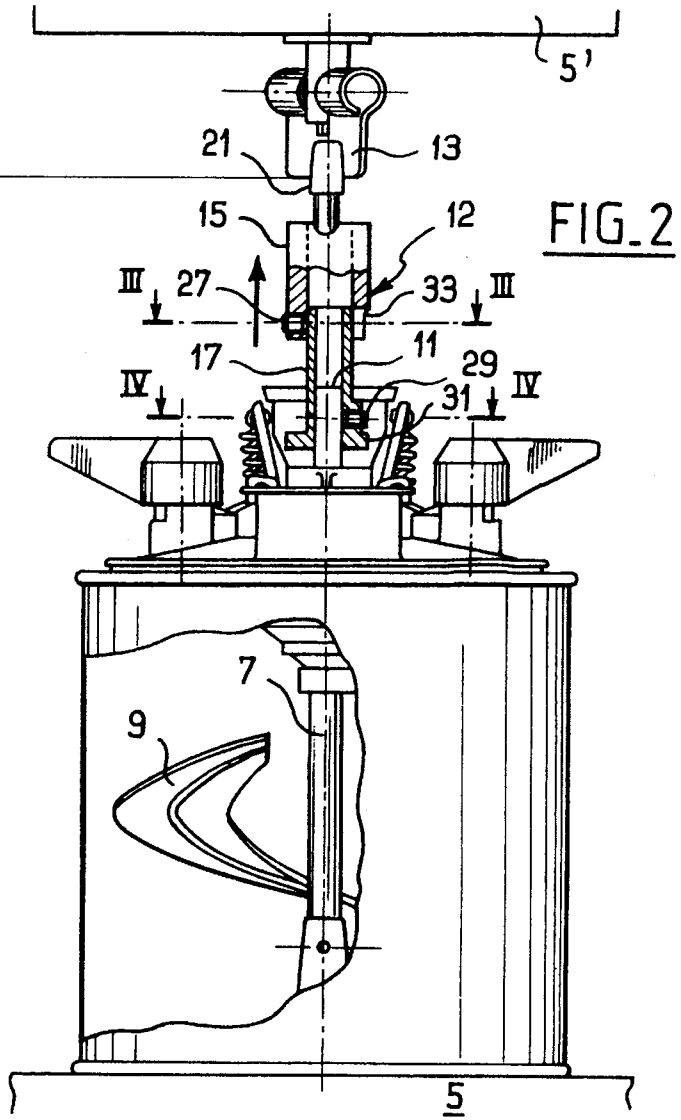
FIG. 2 is a view similar to the previous one showing a driver in the maximum height coupling position.

The embodiment presented relates to the case of the drive by machines with pots placed on the shelves. The stirrer lid 1 and tin of paint 3 assembly represented is placed on a lower machine shelf 5. The stirrer lid 1 carries, in its middle part, the stirrer rod 7 which is equipped with its lower stirring blade 9 (visible in FIG. 2). The stirring rod, of which the upper shank part 11 emerges from the stirrer lid, is rotationally driven by means of the driving connection device, or driver 12 according to the invention, engaged on the corresponding overlying plate 13 of the upper shelf 5', which plate 13 is itself rotationally driven.

Figure 1:
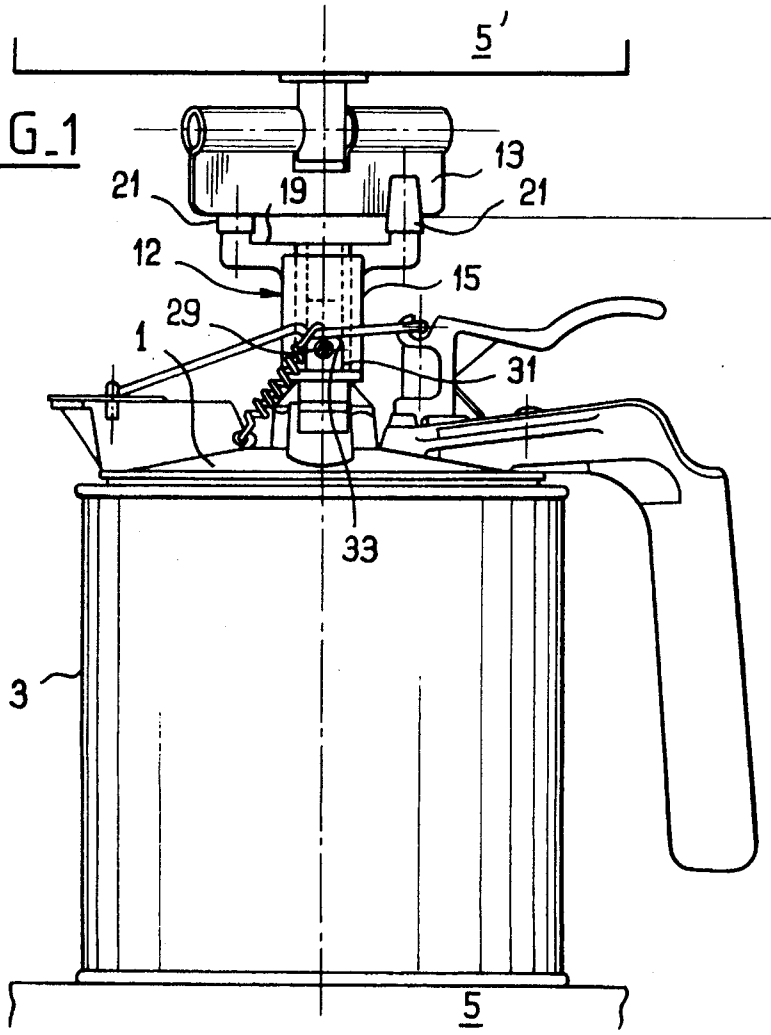
FIG. 1 is an elevation view of a stirrer lid and tin of paint assembly, mounted between two shelves of a paint stirring machine and provided with a driver device according to the invention in the minimum height coupling position.
Figure 3:
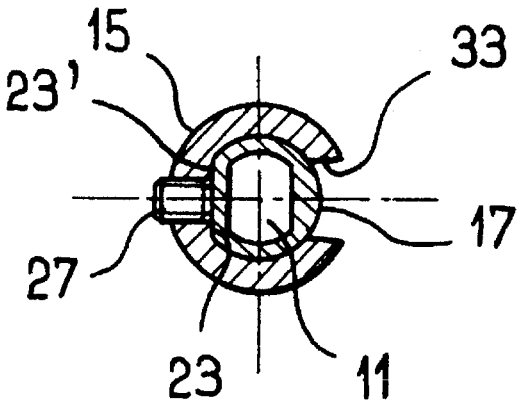
FIG. 3 is a sectional view of the driver device along the line 3—3 of FIG. 2.
Figure 4:
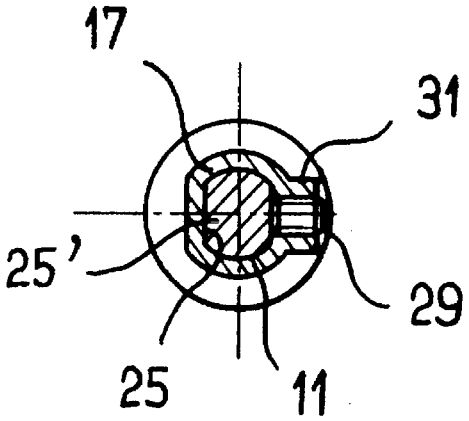
FIG. 4 is a section along the line 4—4 of FIG. 2.

The driver 12 consists of a first tube 15 and of a second tube 17 whose height is equivalent and whose diameter is smaller, mounted so that it can slide inside the first tube. This second tube 17 receives the upper part 11 of the stirrer rod shank. It is also mounted so that it can slide over this rod, which has a freedom of movement only in terms of rotation on the bearing of the lid on which it is mounted. The first tube 15 carries, at its upper part, a fork 19 with two vertical branches 21 which come into contact, at their middle part, on the drive plate 13. Locking in terms of rotation of the first tube on the second one, as well as of the latter on the stirrer rod shank is obtained (FIGS. 3–4) by equipping the corresponding sliding surfaces with at least one longitudinal flat formed on the sliding length. The bore of the first tube 15 is formed with a longitudinal flat 23 engaged on a complementary external flat 23' of the second tube. In a similar fashion, the bore of the second tube is formed with a longitudinal flat 25 interacting with a complementary external flat 25' of the stirrer rod shank. Locking in terms of vertical translation of each of the components is produced by two set screws 27 and 29 which are mounted on each of the tubes of the driver. The screw 27 for locking the tubes is mounted on the first tube 15, at its base, and tightened onto the corresponding flat 23' of the second tube. The screw 29 for locking the driver shank is mounted on the second tube 17, at its base, and so that it is diametrically opposite the first screw; it is tightened onto the corresponding flat 25' of the stirrer rod shank. This second screw is mounted on a base part 31 whose increased thickness is substantially equivalent to the thickness of the first tube 15, so as to obtain a screw thread which is sufficiently long for a tight engagement of this screw on the shank, it being possible for the rest of the tube to be shaped with a reduced thickness which is compatible with the axial and torsional rigidities required for transmitting the rotary forces for driving the stirrer blade. A complementary cutout 33 in this base part 31 is formed at the lower part of the first tube 15 so as to allow the first tube to slide practically over the length of the second one. The distance X represents the maximum permissible heightwise adjustment range for the heightwise coupling of the device, FIG. 2 corresponding to the maximum extension of the driver, and FIG. 1 showing the driver in the minimum height coupling position.

The operation of the device is very simple and simply requires, for a median positional adjustment of the contact of the fork branches 21 on the plate 13, the corresponding fixing of the extension of the driver, by tightening its two screws 27 and 29. Conversely, loosening these screws allows a new heightwise fitting, for example for mounting the same lid on another stirring machine.

Naturally, and by way of an embodiment variant, the number of tubes of the driver, which are slipped telescopically one inside another, may be greater than two.

We claim:

1. Adjustable coupling device for driving a stirrer rod shank of devices including a stirrer lid positioned on a tin of paint located in a paint stirring machine, said coupling device comprising a first tube having a body and upper fork for coupling with a shelf drive plate of the stirring machine, a second tube having a body and a height equivalent to that of the first tube and being of a reduced diameter with respect to the first tube, said second tube being slidably mounted at a clearance within said first tube, said stirrer rod shank projecting from the stirrer lid so as to be slidable at a clearance in said second tube, means for fastening the second tube to the stirrer rod shank and for fastening the second tube relative to the first tube in rotational connection and at a projecting height enabling coupling of said fork to the machine shelf drive plate, said fastening means including two set screws, a first of one said screws engaging the body of the second tube at a base thereof and being tightened against the stirrer rod shank, and said second screw engaging the body of the first tube at the base thereof and being tightened against the second tube.

2. Coupling device according to claim 1, wherein the height of each of said first and second tubes is determined to facilitate fitting of the coupling in the absence of extending a driver of the stirrer rod shank for stirring machines having the narrowest inter-shelf height.

3. Coupling device according to claim 1, wherein locking of said first and second tubes against relative rotation and that of the second tube relative to the shank is obtained by forming sliding surfaces on at least one of said first and second tubes with at least one longitudinal flat extending along a sliding length of said surfaces.

4. Coupling device according to claim 1, wherein the first screw is received in a thickened wall part of the second tube, and wherein the first tube is formed with a complementary cutout.

* * * * *